US008734420B2

(12) United States Patent
Ariagno et al.

(10) Patent No.: US 8,734,420 B2
(45) Date of Patent: May 27, 2014

(54) PACKAGING ASSEMBLY TO PREVENT PREMATURE ACTIVATION

(75) Inventors: Scott R. Ariagno, Palatine, IL (US); Mark D. Schilling, Gurnee, IL (US); Tomas V. Pla, Round Lake, IL (US)

(73) Assignees: Baxter International Inc., Deerfield, IL (US); Baxter Healthcare S.A., Glattpark (Opfikon) (CH)

( * ) Notice: Subject to any disclaimer, the term of this patent is extended or adjusted under 35 U.S.C. 154(b) by 0 days.

(21) Appl. No.: 13/402,560

(22) Filed: Feb. 22, 2012

(65) Prior Publication Data

US 2012/0277715 A1 Nov. 1, 2012

Related U.S. Application Data

(63) Continuation-in-part of application No. 13/217,967, filed on Aug. 25, 2011, now Pat. No. 8,545,476.

(60) Provisional application No. 61/376,912, filed on Aug. 25, 2010.

(51) Int. Cl.
*A61J 1/20* (2006.01)

(52) U.S. Cl.
USPC ..... 604/414; 604/403; 604/411; 206/364; 206/370; 206/438; 206/493

(58) Field of Classification Search
None
See application file for complete search history.

(56) References Cited

U.S. PATENT DOCUMENTS 4,197,947 A * 4/1980 Zaidi ..... 206/438
4,576,211 A 3/1986 Valentini et al.
4,722,733 A * 2/1988 Howson ..... 604/411
4,759,756 A 7/1988 Forman et al.
5,116,316 A 5/1992 Sertic et al.
5,342,346 A 8/1994 Honda et al.
5,407,070 A * 4/1995 Bascos et al. ..... 206/365
5,445,631 A * 8/1995 Uchida ..... 604/412
5,466,220 A * 11/1995 Brenneman ..... 604/87
5,478,337 A 12/1995 Okamoto et al.
5,779,668 A 7/1998 Grabenkort
6,022,339 A 2/2000 Fowles et al.
6,070,623 A 6/2000 Aneas
D430,015 S * 8/2000 Himbert et al. ..... D9/345
6,113,583 A 9/2000 Fowles et al.
6,258,078 B1 7/2001 Thilly
6,558,365 B2 5/2003 Zinger et al.
6,571,837 B2 6/2003 Jansen et al.
6,582,415 B1 6/2003 Fowles et al.
6,645,171 B1 11/2003 Robinson et al.

(Continued)

FOREIGN PATENT DOCUMENTS

DE 69903266 T2 6/2003
DE 102006031712 B3 7/2006
EP 0614653 A3 9/1994
WO WO2008006439 A1 1/2008

*Primary Examiner* — Tan-Uyen Ho
*Assistant Examiner* — Eric Bryant
(74) *Attorney, Agent, or Firm* — K&L Gates LLP

(57) ABSTRACT

A package assembly for a drug reconstitution assembly includes a body, a drug reconstitution assembly and a removable lid. The body includes a plurality of protrusions configured to mate with a plurality of corresponding features of the drug reconstitution assembly to inhibit axial and rotational translation of the drug reconstitution assembly and its constituent parts during shipping and handling. By preventing axial and rotational shifting during shipment, premature and accidental puncture or contamination of the medication or the spikes within the drug reconstitution assembly is minimized.

20 Claims, 8 Drawing Sheets

(56) References Cited

U.S. PATENT DOCUMENTS

| | | | | |
|---|---|---|---|---|
| 6,706,031 | B2 * | 3/2004 | Manera | 604/411 |
| 6,852,103 | B2 | 2/2005 | Fowles et al. | |
| 6,890,328 | B2 | 5/2005 | Fowles et al. | |
| 6,915,823 | B2 | 7/2005 | Osborne et al. | |
| 6,948,522 | B2 | 9/2005 | Newbrough et al. | |
| 7,358,505 | B2 | 4/2008 | Woodworth et al. | |
| 7,425,209 | B2 | 9/2008 | Fowles et al. | |
| 7,540,863 | B2 | 6/2009 | Haindl | |
| 7,753,085 | B2 | 7/2010 | Tribble et al. | |
| 8,100,154 | B2 | 1/2012 | Reynolds et al. | |
| 2001/0003996 | A1 | 6/2001 | Jansen et al. | |
| 2002/0087141 | A1 | 7/2002 | Zinger et al. | |
| 2002/0123736 | A1 | 9/2002 | Fowles et al. | |
| 2003/0036725 | A1 | 2/2003 | Lavi et al. | |
| 2003/0199846 | A1 | 10/2003 | Fowles et al. | |
| 2004/0045567 | A1 | 3/2004 | Lewis et al. | |
| 2004/0059312 | A1 | 3/2004 | Frezza et al. | |
| 2004/0112457 | A1 * | 6/2004 | Norton et al. | 141/26 |
| 2004/0154690 | A1 | 8/2004 | Osborne et al. | |
| 2004/0199139 | A1 | 10/2004 | Fowles et al. | |
| 2004/0241041 | A1 | 12/2004 | Woodworth et al. | |
| 2004/0249341 | A1 | 12/2004 | Newbrough et al. | |
| 2005/0133729 | A1 | 6/2005 | Woodworth et al. | |
| 2005/0137566 | A1 | 6/2005 | Fowles et al. | |
| 2007/0088315 | A1 | 4/2007 | Haindl | |
| 2007/0125442 | A1 | 6/2007 | Tribble et al. | |
| 2007/0265574 | A1 * | 11/2007 | Tennican et al. | 604/190 |
| 2008/0172001 | A1 | 7/2008 | Reynolds et al. | |
| 2008/0188799 | A1 | 8/2008 | Mueller-Beckhaus et al. | |
| 2008/0300570 | A1 | 12/2008 | Fowles et al. | |
| 2009/0182300 | A1 | 7/2009 | Radmer et al. | |
| 2009/0318893 | A1 | 12/2009 | English | |
| 2010/0004618 | A1 | 1/2010 | Rondeau et al. | |
| 2010/0106129 | A1 | 4/2010 | Goeckner et al. | |
| 2010/0161113 | A1 | 6/2010 | Tribble et al. | |
| 2010/0168712 | A1 | 7/2010 | Tuckwell et al. | |
| 2010/0191182 | A1 | 7/2010 | Smith et al. | |
| 2010/0217431 | A1 | 8/2010 | Tribble et al. | |

* cited by examiner

PACKAGING ASSEMBLY TO PREVENT PREMATURE ACTIVATION

PRIORITY CLAIM

This application claims priority to an the benefit as a continuation-in-part of U.S. patent application Ser. No. 13/217,967 ("the '967 Application"), filed on Aug. 25, 2011, which is a non-provisional application of U.S. Provisional Application No. 61/376,912, filed on Aug. 25, 2010.

BACKGROUND

The present disclosure relates generally to packaged medical device assemblies and more specifically to combinations of packages with medical devices.

Certain drugs are supplied in lyophilized form. The lyophilized drug must be mixed with water to reconstitute the drug into a form suitable for injection into a patient. In particular, the components that form the injectable solution must be sterile to avoid infection. The reconstitution process presents difficulties to patients or caregivers who need to inject themselves or another, for example, in a home environment. The patient or caregiver has to follow a sequential manipulation of the drug container, the diluent container and the transfer syringes, which use needles to penetrate the stoppers associated with the respective containers. The patient or caregiver needs to follow established aseptic practices to avoid contamination.

As described in the '967 Application, the drug container, the diluent container and the transfer syringes of the device are mounted within a same housing at time of shipping from the manufacturer, distributor or assembler to the end user. Due to the specific arrangement of the transfer syringes with respect to each of the drug containers, extra care is taken to prevent accidental premature puncture or activation of the stoppers of the containers by the transfer syringes during shipment and handling. Shipment of reconstitution devices accordingly presents challenges in preventing premature activation of the product, ensuring sterility and enabling ease of use of the product by the end user. The lyophilized drugs are often very expensive, making the minimization of accidental activation or contamination suffered during shipment even more important.

SUMMARY

The present disclosure provides a packaged assembly including a package and a reconstitution assembly and associated medical products, which prevent premature activation of the reconstitution assembly. The package is shaped to cradle the reconstitution assembly. The package integrates with pertinent features of the reconstitution assembly, and maintains the isolation of various parts of the reconstitution assembly from one another in the package during shipment and handling.

In one embodiment, the reconstitution assembly includes a housing having an upper sleeve and lower sleeve. The housing defines a generally tubular passageway and includes a plurality of radially spaced apertures in the upper sleeve, and a plurality of radially spaced windows in the lower sleeve. A transfer set assembly is disposed within the housing between the lower sleeve and the upper sleeve. The transfer set assembly includes a pair of opposing spikes including an upper spike and a lower spike. The upper and lower spikes form part of a flow path.

A first container is disposed at least partially inside the upper sleeve of the housing, within the passageway and near the upper spike. The first container includes a first vial and a first stopper providing a sterile barrier to the medicament contents held within the first vial. The first container is disposed in one embodiment so that the first stopper faces downward or towards a center of the housing. A second container is disposed inside the lower sleeve within the passageway near the lower spike. The second container includes a second vial and a second stopper providing a sterile barrier to the contents of the second vial. The second container is disposed in one embodiment so that the second stopper faces upward towards the first stopper. The flow path formed by the spike allows the containers when spiked to communicate fluidly with each other.

In an embodiment, the upper spike of the transfer set assembly pierces the first stopper upon application of a first force to the first container. The force can be from the patient or caregiver pressing down on the first container to push the first container into the housing and onto the upper spike. Subsequent to the upper spike piercing the first stopper of the first container, the second container is allowed to move axially relative to the transfer set assembly. The lower spike of the transfer set assembly then pierces the second stopper upon application of a second force and the engagement of a triggering mechanism by the first container, and specifically the first vial of the first container. When the second stopper is pierced, the vacuum of the second container is accessed. The first and second forces may be predetermined forces or at a desired level.

In an embodiment, the first container encloses a liquid and the second container encloses a lyophilized product. Piercing the first stopper of the first container with the upper spike, and piercing the second stopper of the second container with the lower spike places the first and second containers into fluid communication with each other through the flow path of the transfer set assembly. The vacuum of the second container then causes the liquid of the first container to aspirate through the fluid pathway into the second container. The liquid mixes with the lyophilized drug to formulate the drug for patient use.

The packaging assembly is constructed so that the reconstitution assembly fits within the package and the package physically inhibits axial translation of either the first container or the second container within the housing. By inhibiting any significant axial translation of the first or second containers within the housing, accidental or premature piercing of either the first stopper of the first container by the upper spike or the second stopper of the second container by the lower spike is prevented.

In an embodiment, the package includes an interior chamber formed with a plurality of recesses and protrusions that are shaped to compliment mating features of the reconstitution assembly. The interior chamber of the package is formed such that the reconstitution assembly properly engages with the complimentary recesses and protrusions of the package in a predetermined configuration. For example, there are first and second recesses at the ends of the package that cradle the first and second vials of the first and second containers extending from the housing of the reconstitution assembly. A plurality of protrusions extending into the interior chamber of the package match with and extend through a plurality of apertures in the upper sleeve and a plurality of apertures in the lower sleeve of the reconstitution assembly housing.

The apertures in the housing allow the protrusions of the package body to extend into the passageway formed by the housing, and engage the vials around a portion of the neck of the vials, which can be small glass bottles with necked openings. The protrusions catch the housing apertures so as to prevent the first and second respective containers from rotating within the package. The engagement of the protrusions with the necks of the vials also prevents inadvertent axial translation of the containers relative to either one another, the transfer set assembly, or the housing. By keeping the first and second containers generally axially static relative to one another and relative to the transfer set assembly, the protrusions of the interior chamber of the package body maintain the upper spike and the lower spike at a separation distance from each of the first container and the second container respectively. Because the axial translation of the components of the reconstitution assembly during shipping or handling is minimized or prevented, the instances of premature puncture of the first or second containers by the respective spikes of the transfer set assembly is also minimized.

Additional features and advantages are described herein, and will be apparent from the following Detailed Description and the figures.

DETAILED DESCRIPTION

The present disclosure provides a packaged assembly including an assembled package and reconstitution assembly. The packaged assembly is especially useful for preventing premature activation of the reconstitution assembly during shipping and handling. Although the packaged assembly is described primarily herein as including a reconstitution assembly, it will be apparent that the an appropriately configured package may be used during shipment of other drug assemblies, or other products that have components separated prior to use.

Figure 1:
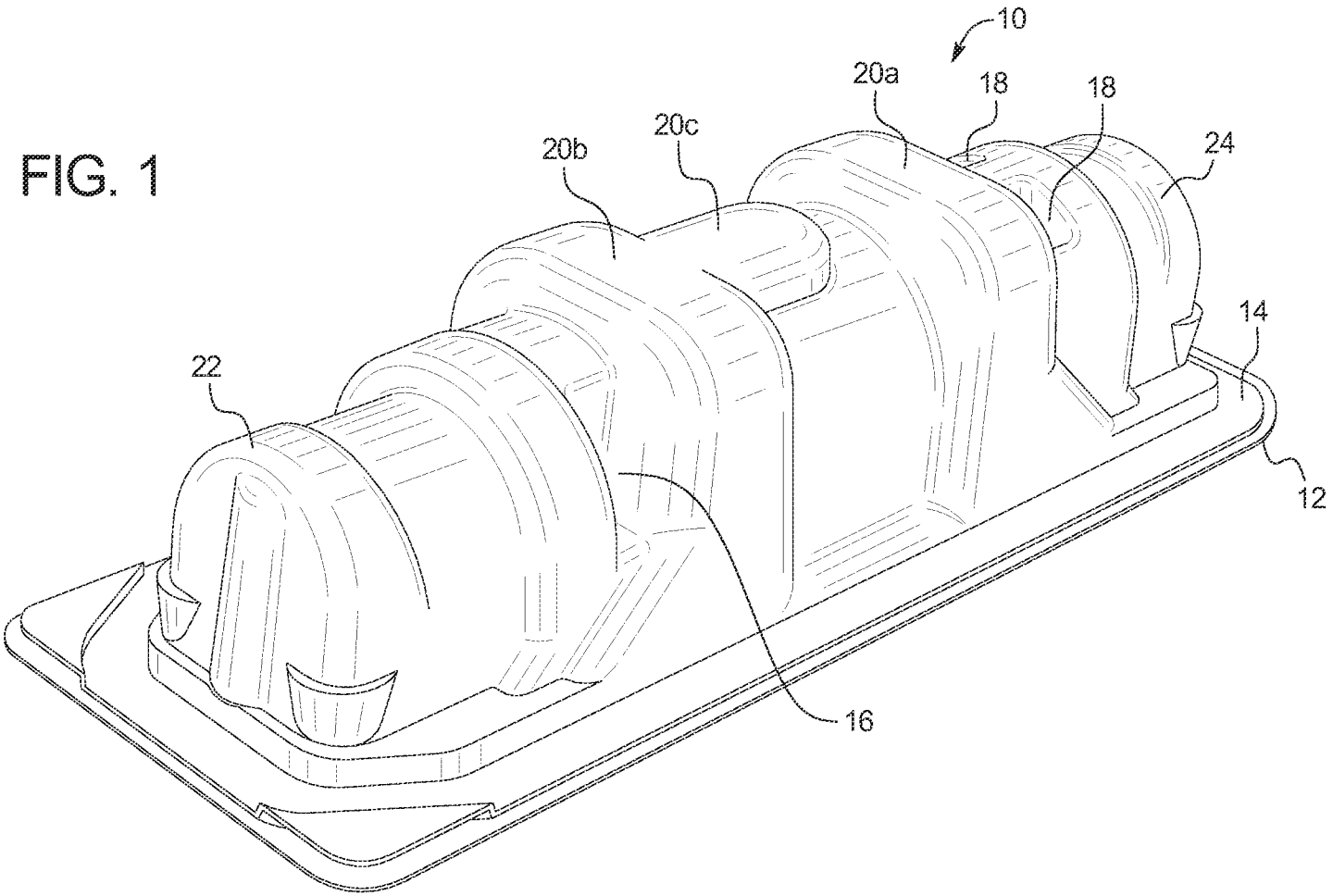
FIG. 1 is a perspective view of one embodiment of an assembled package of the present disclosure.
Figure 2:
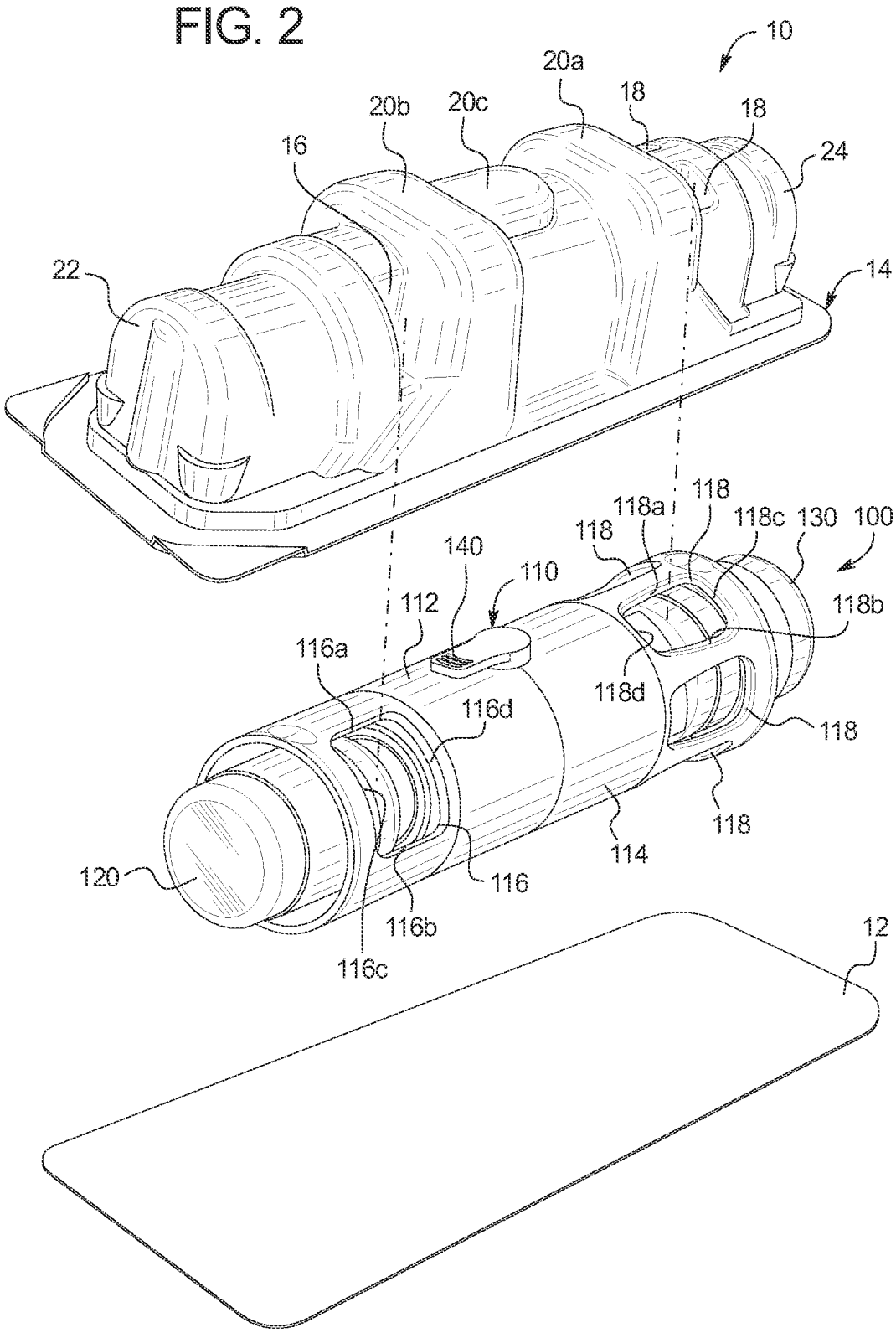
FIG. 2 is an exploded view of one embodiment of the package, a reconstitution assembly contained in the package and a cover for the package of the present disclosure.

Referring now to the drawings and in particular to FIGS. 1 and 2, an assembled package 10 is generally indicated. Assembled package 10 in general includes a removable lid 12, a body 14, and a drug reconstitution assembly 100 (FIG. 2).

Removable lid 12 can be made of any one or more of a high-density polyethylene fibers, such as TYVEK®, a foil material or a paper material, and is adhered to the body 14 with heat activated adhesive in one embodiment. The adhesive and application process enables removable lid 12 to remain securely adhered to the body 14 but to also be relatively easily removed by the patient.

Body 14 can be constructed from a thermoformable polyethylene terephthalate ("PET") material. Body 14 can be formed into its desired shape with protrusions 16, 18, wells 20*a* to 20*c*, etc., formed via a thermoforming process. In an alternative embodiment, body 14 is made of a polymeric material and is formed via an injection molding process.

As illustrated in FIGS. 1 and 2, lid 12 attaches sealingly and removably to body 14 to enclose the drug reconstitution assembly 100 within package 10. Removable lid 12 can provide a flat surface upon which manufacturer instructions and identifying information can be displayed. The information identifiers may include barcodes, picture codes, company information and internet addresses directing the user to more detailed information. The information may include medication information, patient identification and prescription information, manufacturer information, licensing and governmental agency information, creation and expiration date information, and directions for use.

As illustrated in FIGS. 1 and 2, body 14 is formed to define an interior chamber, which includes a plurality of protrusions 16 and 18 that protrude into the chamber and wells 20*a* to 20*c* that extend away from the interior of the chamber. These features are described in greater detail below. As used herein, protrusions in general extend in towards a center of the interior chamber of body 14, while wells in general extend out away from the center of the interior of the chamber.

The interior chamber accepts drug reconstitution assembly 100 as illustrated in HG. 2. Drug reconstitution assembly 100 includes a housing 110 having an upper portion 112 (when held for use) and a lower portion 114 (when held for use). The upper portion 112 and lower portion 114 form a generally cylindrical passageway. The drug reconstitution assembly 100 also includes an upper container 120 (when held for use) housed at least partially within the passageway formed by the upper portion 112 of the housing, a lower container 130 (when held for use) housed at least partially within the passageway formed by a lower portion 114 of the housing, and an access port plug 140 provided on the outside of housing 110. Removable lid 12 of package 10 attaches sealingly to body 14 to enclose the drug reconstitution assembly 100 within the body 14.

Figure 3:
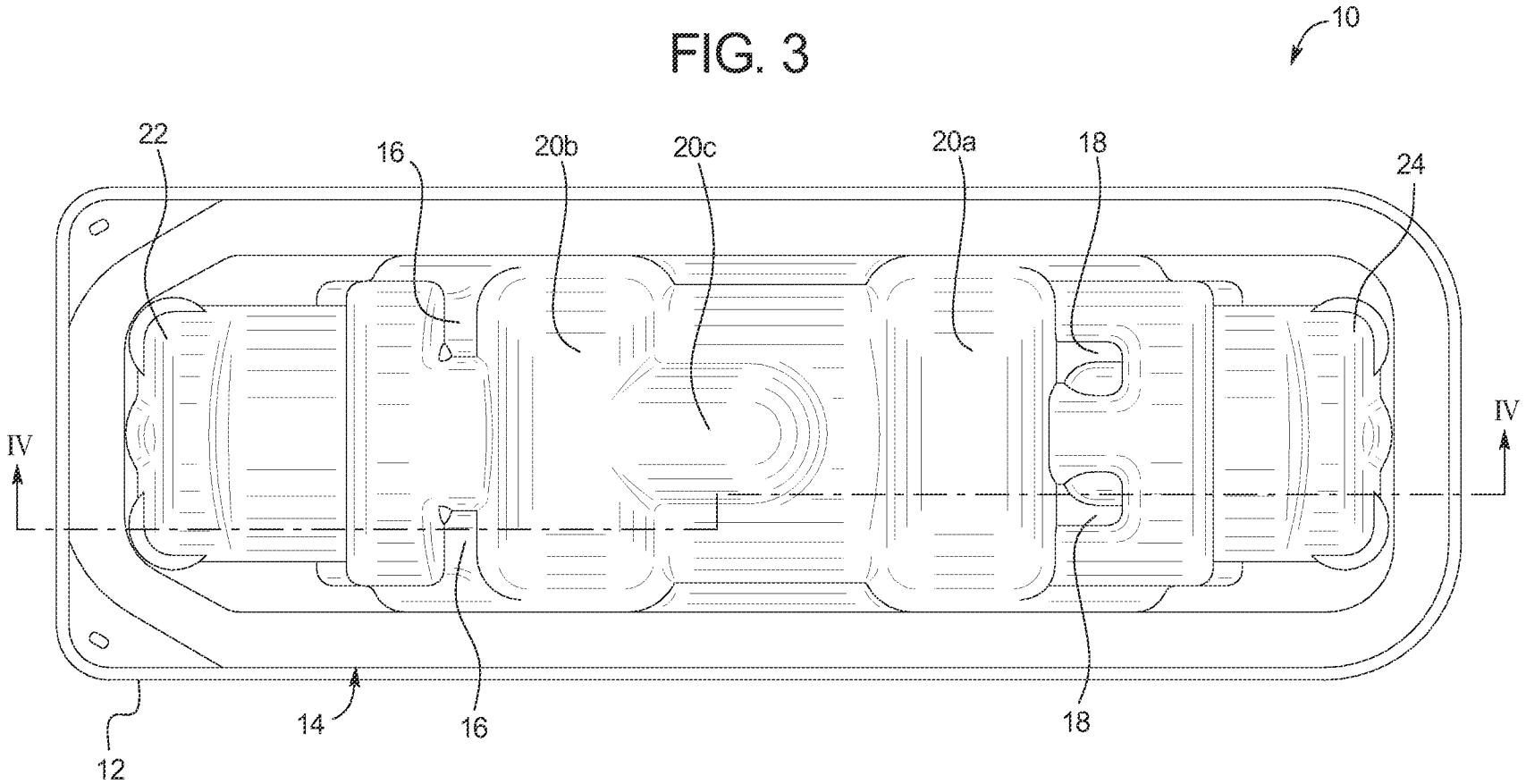
FIG. 3 is a body-side view of one embodiment of the assembled package and drug reconstitution assembly of the present disclosure.

Referring now to FIG. 3, a body side view of the assembled package 10 from the outside looking in is illustrated. A first pair of protrusions 16 and a second pair of protrusions 18 extend from the surrounding surface of body 14 into the interior chamber to contact mating features of drug reconstitution assembly 100. Wells 20*a*, 20*b*, and 20*c* extend outwardly from the interior chamber relative to surrounding surfaces of body 14. Wells 20*a*, 20*b*, and 20*c* are at least substantially flat and coplanar with each other (see also FIGS. 1 and 2), such that package 10 can be rested on the body side by setting wells 20*a*, 20*b*, and 20*c* onto a stable surface. Body 14 also forms wells 22 and 24 at the upper and lower ends of body 14 as illustrated in FIGS. 1 to 3.

Figure 4:
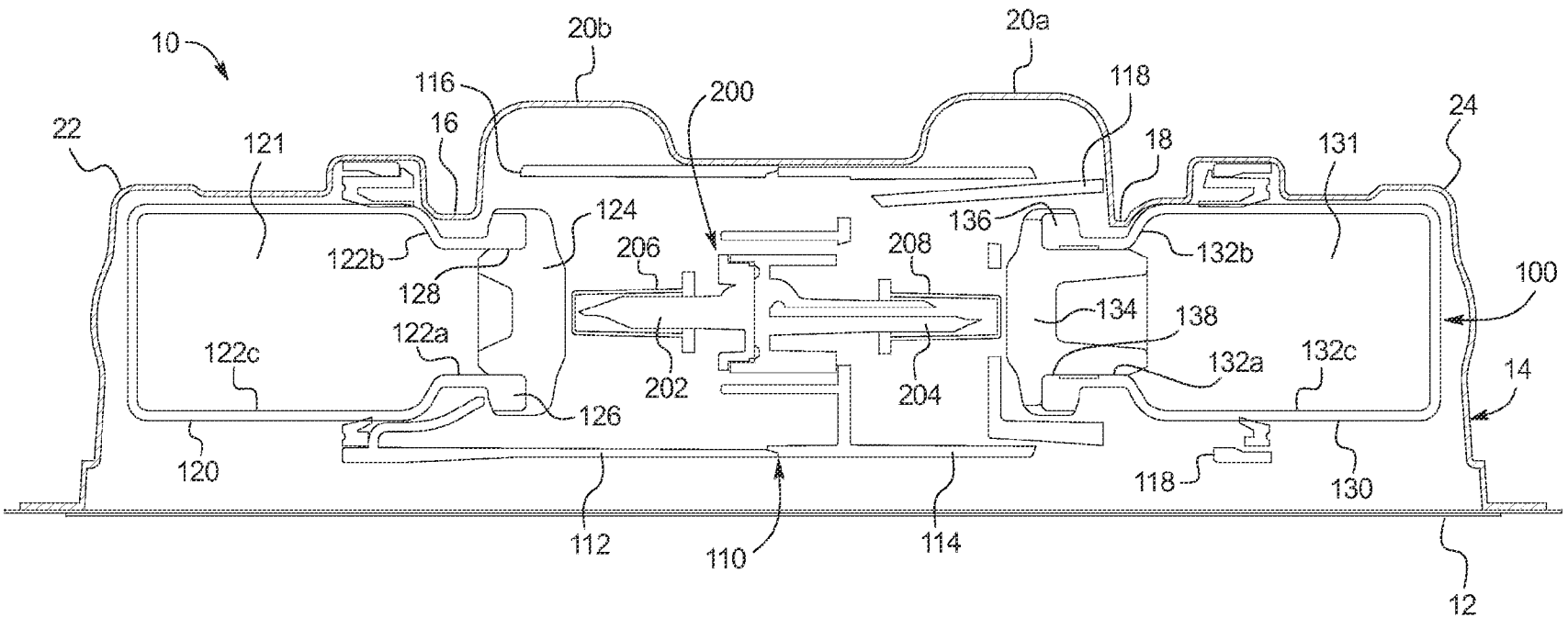
FIG. 4 is a sectioned view of the assembled package of FIG. 3 taken along line IV-IV of FIG. 3.

Referring now to FIG. 4, a cross-sectional side view of FIG. 3 taken along the line IV-IV is illustrated. Due to the radial spacing and geometry of protrusions 16 compared to the radial spacing and geometry of protrusions 18, line IV-IV has been staggered in FIG. 3 to better show the cross-sections of both protrusions 16 and 18 in the single view of FIG. 4. The cross-section view of the reconstitution assembly 100 and its housing 110 illustrate the contents of the reconstitution assembly. Specifically, the reconstitution assembly 100 includes first or upper container 120, second or lower container 130, and a transfer set assembly 200.

As discussed in detail in the '967 Application incorporated herein by reference, transfer set assembly 200 includes an upper spike 202, a lower spike 204, and a flow path that travels through the upper spike 202 and the lower spike 204. Upper spike 202 faces an opening 128 of the upper container 120, while lower spike 204 faces an opening 138 of the lower container 130. In various embodiments, the plastic part of transfer set assembly 200 is made of a suitable moldable and sterilizable plastic such as acrylonitrile butadiene styrene ("ABS"), polycarbonate ("PC") or acrylic.

Upper spike 202 can include an upper boot 206 configured to cover and maintain sterility of a lower portion of the upper spike and its flow path portion. Similarly, the lower spike 204 includes a lower boot 208 configured to cover and maintain sterility of an upper portion and the flow path in the lower spike. Upper 206 and lower 208 boots in one embodiment are made with an elastomeric material that is relatively easily punctured by the upper spike 202 and lower spike 204 respectively, upon activation of the drug reconstitution assembly 100.

Transfer set assembly 200 can also include a syringe port pathway (beneath plug 140 illustrated in FIG. 2) that is generally perpendicular to and maintains a valved fluid communication with the flow path traveling through the upper spike 202 and the lower spike 204. The syringe port pathway can alternatively extend non-perpendicularly from the flow path of the transfer set assembly 200. The syringe port pathway communicates with a syringe port extending through housing 110 of reconstitution assembly 100. In FIG. 2, a syringe port plug 140 engages the syringe port to maintain the sterility of the port and connecting flow paths.

After full activation of the drug reconstitution assembly 100, a user removes the syringe port plug 140 to reveal the syringe port that the user can access via a separate syringe. Syringe port plug 140 is made of an elastomeric or a rubber material, such that it can be bent for grasping and removing. The syringe port pathway and spike flow paths allow fluid communication from the syringe port to the upper and lower containers 120 and 130.

Upper 120 and lower 130 containers include upper 121 and lower 131 vials, which are made of a suitable medical grade, sterilizable glass or plastic, for example. Upper vial 121 and lower vial 131 are each generally cylindrical and have similar geometries, including a neck portion 122*a*, 132*a*, a main portion 122*c*, 132*c*, and a rim portion 126, 136. The neck portion 122*a*, 132*a* has a smaller diameter than either the main portion 122*c*, 132*c* or the rim portion 126, 136. Upper stopper 124 sealingly plugs the upper opening 128 of the upper vial 121 to prevent contamination or leakage of the contents of the upper container 120. Similarly, lower stopper 134 sealingly plugs the lower opening 138 of the lower vial 131 to prevent contamination or leakage of the lower container 130. Upper stopper 124 and the lower stopper 134 can be made of rubber or an elastomeric material. It should be appreciated that the assembly of the upper vial 121 and the upper stopper 124 is defined herein as the upper container 120. Similarly, the assembly of the lower vial 131 and the lower stopper 134 is defined herein as the lower container 130.

Housing 110 of reconstitution assembly 100 includes an upper housing portion 112 and a lower housing portion 114, which again can be made of acrylonitrile butadiene styrene ("ABS"), polycarbonate ("PC") or acrylic. Upper housing portion 112 includes or defines a plurality of apertures 116, while lower housing portion 114 includes or defines a plurality of apertures 118 (illustrated best in FIG. 2). Apertures or windows 116 and 118 are each spaced apart radially around the respective housings. Apertures 116, 118 allow for gas sterilization to flow to the internal parts and components of reconstitution assembly 100. In addition to easing the sterilization process, apertures 116, 118 provide at least partial access to the upper 120 and lower 130 containers when housed within reconstitution housing 110.

As is discussed in more detail in the '967 Application, upon activation of the drug reconstitution assembly 110, the upper spike 202 penetrates the upper boot 206 and upper stopper 124 to access the contents of the upper container 120, after which the lower spike 204 penetrates the lower boot 208 and lower stopper 134 to access the contents of the lower container 130. A flow path is created between the upper container 120 and the lower container 130 when the upper 202 and lower spikes 204 have accessed the contents of the upper 120 and lower containers 130 respectively. The '967 Application discusses other internal mechanisms of assembly 110 that ensure that upper container 120 travels towards the upper spike 202, and that the upper stopper 124 is fully penetrated by the upper spike 202 before tower spike 204 can contact the lower stopper 134 of the lower container 130.

FIG. 4 illustrates how containers 120 and 130 fit within housing 110 of the drug reconstitution assembly 100 and how the drug reconstitution assembly 100 fits within the interior chamber of package body 14 during shipment (unactivated state). As illustrated, upper container 120 fits at least partially within the upper housing portion 112. The upper rim 126 of upper vial 121 and upper stopper 124 are each oriented toward the transfer set assembly 200 and upper spike 202. In the illustrated unactivated state, upper stopper 124 of upper container 120 is disposed near the upper spike 202, but not in contact with the upper spike 202.

Upper housing portion 112 in one embodiment includes three apertures 116 substantially evenly radially disposed about the upper housing portion 112, as partially illustrated in FIG. 2. It should be appreciated that any number of apertures may be incorporated into the upper housing portion 112, and the spacing need not be equal or radial. Upper housing portion 112 is formed such that when upper container 120 is secured in its shipping configuration, various features of upper vial 121, such as the upper shoulder 122*b*, upper neck 122*a*, and upper rim 126, are aligned longitudinally with the apertures 116.

Similar to the upper container 120, the lower container 130 fits at least partially within the lower housing portion 114. Lower rim 138 of lower vial 131 and lower stopper 134 are each oriented towards lower spike 204 of the transfer set assembly 200. In the unactivated state (as illustrated), lower stopper 134 of the lower container 130 is disposed near the lower spike 204, but not in contact with the lower spike 204 of the transfer set assembly 200.

The lower housing portion 114 in one embodiment includes six apertures 118 evenly, radially disposed about the lower housing portion 114, as partially illustrated in FIG. 2. Any suitable number of apertures may be incorporated into the lower housing portion 114 and need not be the spaced evenly or radially. In FIG. 4 two of apertures 118 of lower housing portion 114 are visible. Lower housing portion 114 is formed such that when lower container 130 is secured in its shipping configuration, various features of lower vial 131, such as lower shoulder 132*b*, lower neck 132*a*, and the lower rim 136, are aligned longitudinally with apertures 118.

It is important that upper container 120 and the lower container 130 do not shift out of their shipping configuration before the user intentionally activates drug reconstitution assembly 100. Such an undesirable displacement of either the upper container 120 or the lower container 130, caused by shipment, handling, or mishandling, could result in premature contact between the upper 202 or lower 204 spikes and the respective upper 124 or lower 134 stoppers. Even rupture or disturbance of the relatively thin boots 206 and 208 by the respective spikes 202 and 204 can destroy the sterile environment of the flow path traveling through the spikes 202 and 204 of the transfer set assembly 200. Package 10 prevents these undesirable displacements as discussed in detail below.

It should be appreciated that, for the present disclosure, an undesirable displacement defines any one of a plurality of different resulting positions of the upper 120 and lower 130 containers, the upper 202 and lower 204 spikes, the upper 124 and lower 134 stoppers, the upper 206 and lower 208 boots, the transfer set assembly 200, and the housing 110. Each of the undesirable displacement positions that could occur unintentionally during shipping is prevented by the body 14's interaction with the drug reconstitution assembly 100. Described below are several undesirable displacement positions. It should be appreciated that, although discussed with respect to both the upper and lower containers, it is contemplated that each of the undesirable displacement positions applies either individually or collectively to each of the upper 120 and lower 130 containers.

In a first undesirable displacement position, the upper container 120 or lower container 130 axially shifts relative to the transfer set assembly 200 such that the upper stopper 124 or lower stopper 134 makes contact with upper boot 206 or lower boot 208, which in turn makes contact with and is at least partially pierced by upper spike 202 or lower spike 204, respectively. It should be appreciated that in the first undesirable displacement position, the respective spike 202, 204 does not fully penetrate the upper 124 or lower 134 stopper. In the first undesirable displacement position, the puncture of the upper 206 and tower 208 boots by the respective upper 202 and lower 204 spikes makes the transfer set assembly 200 and its flowpath susceptible to contamination.

In a second undesirable displacement position, the upper container 120 or lower container 130 axially shifts relative to the transfer set assembly 200 such that the upper stopper 124 or lower stopper 134 makes contact with upper boot 206 or lower boot 208, respectively. The upper boot 206 or lower boot 208, in turn, is forced against the upper spike 202 or lower spike 204 by the axial translation of the respective container. In the second undesirable displacement position, the upper spike 202 or lower spike 204 each fully penetrate the respective boots 206, 208, and at least partially penetrate the stoppers 124, 134 of respective containers 120, 130. In the second undesirable displacement position of various embodiments, the spikes 202, 204 fully penetrate the respective stoppers 124, 134. In the second undesirable position, the partial or full penetration of the upper 124 or lower 134 stoppers by the upper 202 or lower 204 spikes leads to an increased chance of contamination of the transfer set assembly 200, as well as contamination of the contents of either container 120 or 130.

In a third undesirable displacement position, the upper container 120 or lower container 130 radially or axially shifts relative to the housing 110, causing a failure of the seals between vials 121, 131 and the interior of housing 110. In the third undesirable displacement position, failed seals could reduce the secure positioning of the upper container 120 and lower container 130 within the housing 110, thereby increasing the likelihood of premature axial translation, and lead to an additional undesirable displacement position.

Prior to attachment of removable lid 12 to body 14, drug reconstitution assembly 100 is inserted into the interior chamber of the body 14. In doing so, protrusions 16 and 18 and wells 20*a* to 20*c*, 22 and 24 mate with different features of the drug reconstitution assembly 100 including and the upper 120 and lower 130 containers held within the drug reconstitution assembly 100.

Figure 5:
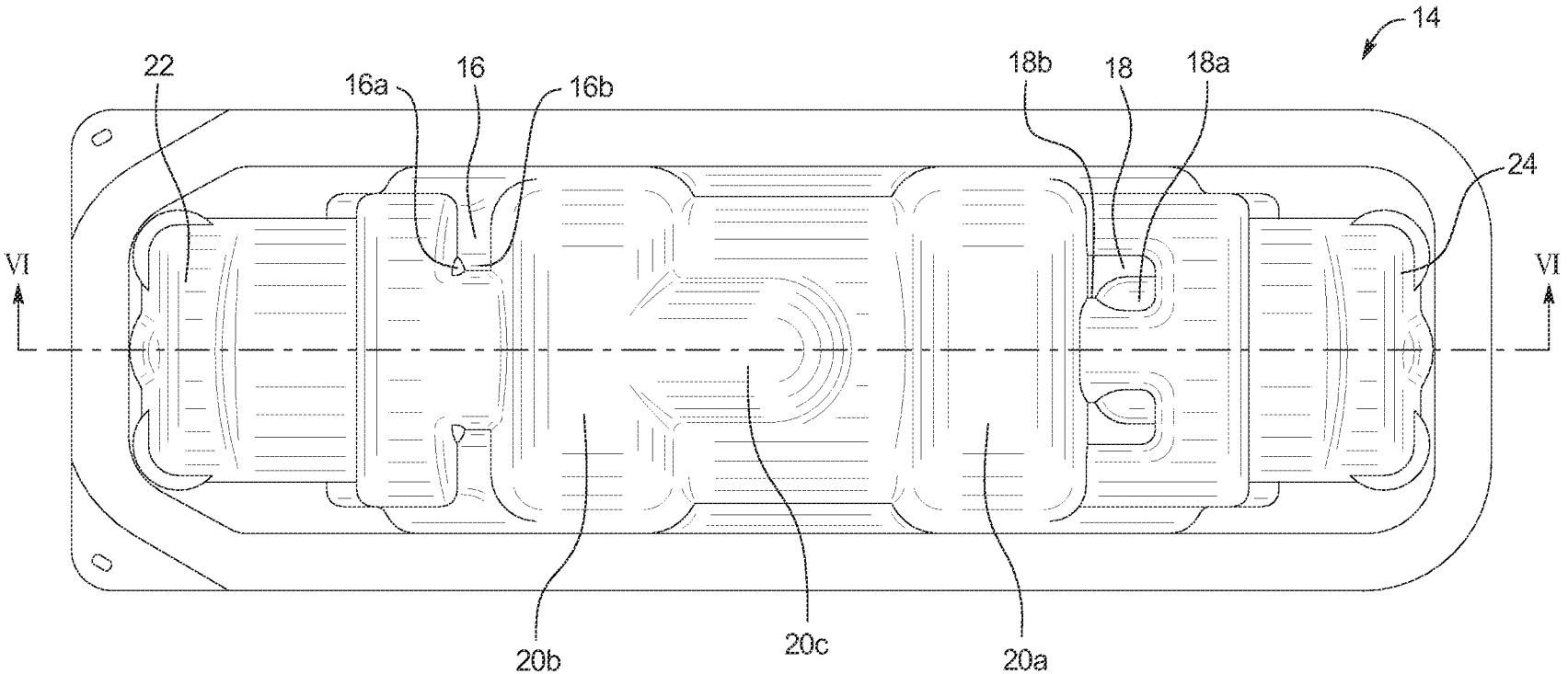
FIG. 5 is a bottom view of one embodiment of the package of the present disclosure.
Figure 6:
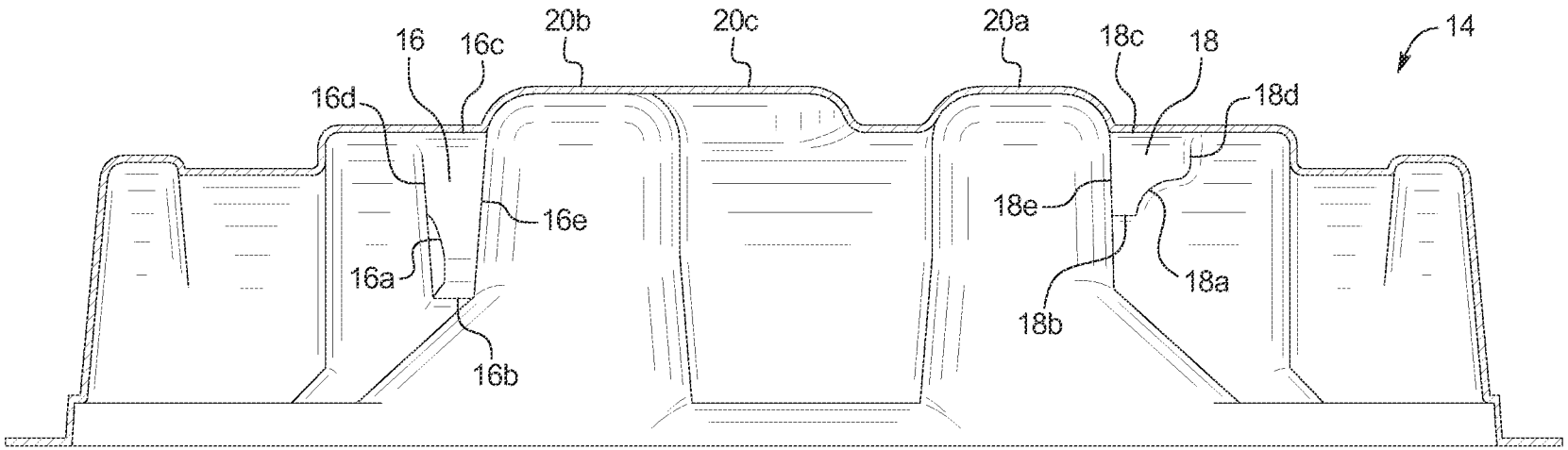
FIG. 6 is a sectioned view of the package of FIG. 5 taken along line VI-VI of FIG. 5.
Figure 7:
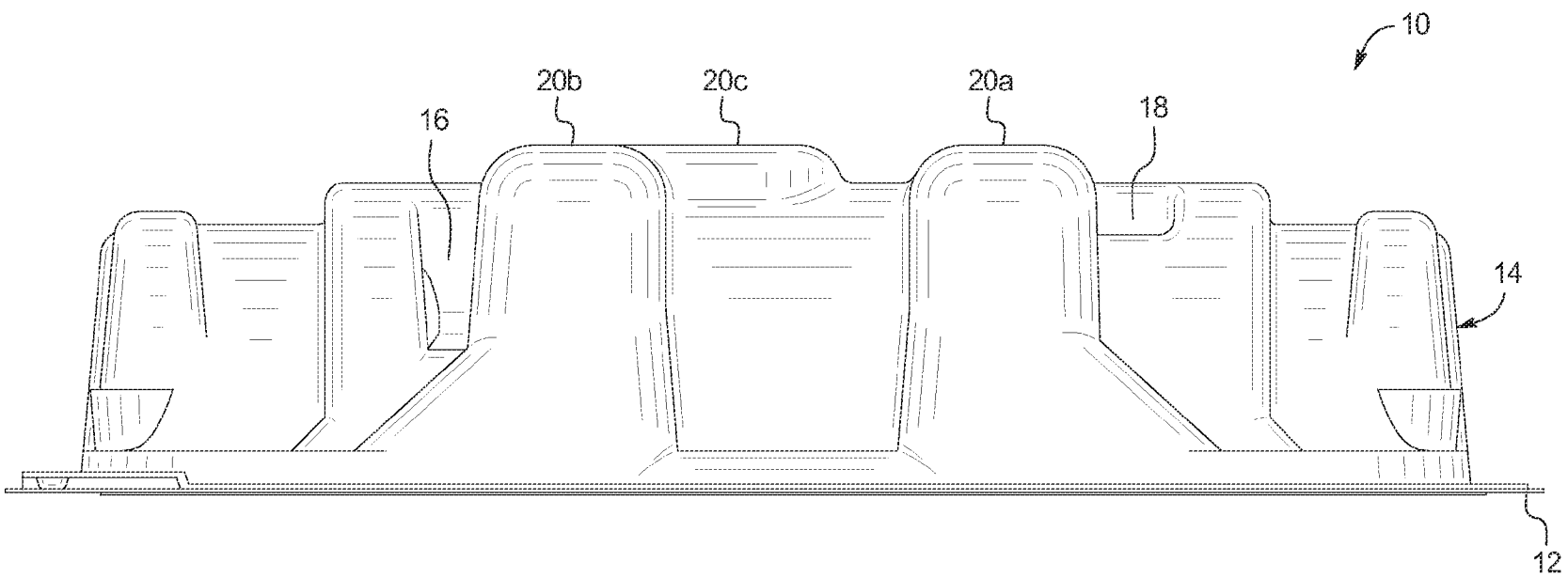
FIG. 7 is a side elevation view of one embodiment of the assembled package of the present disclosure.
Figure 8:
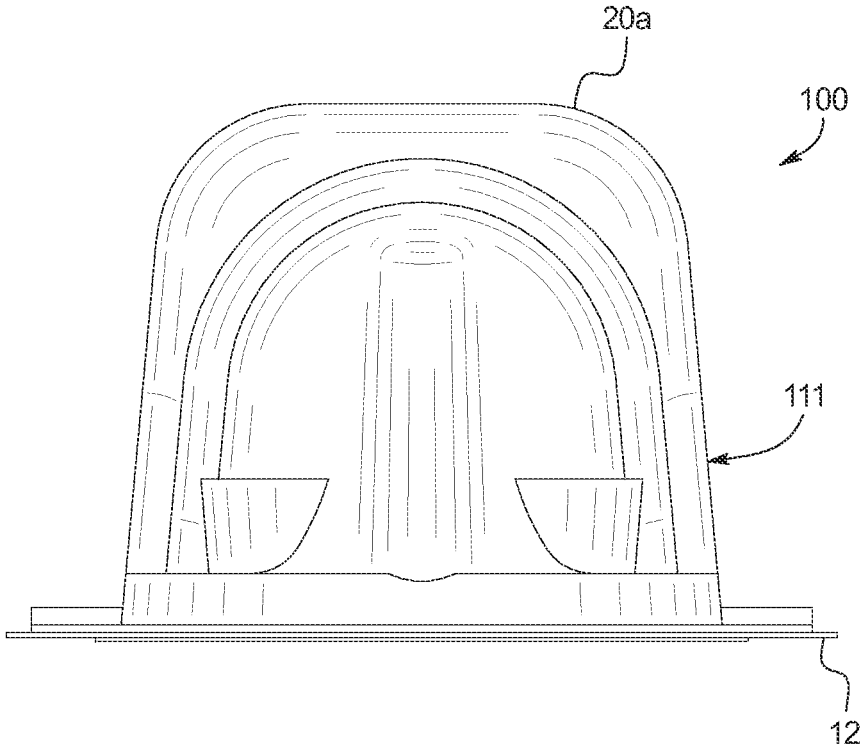
FIG. 8 is an end elevation view of one embodiment of the assembled package of the present disclosure.

Referring now to FIGS. 5 and 6, the protrusions and wells are further illustrated. Wells 20*a*, 20*b* and 20*c* extend outwardly from the body 14 and form a substantially coplanar surface on which the assembly 10 can be supported. Well 20*c* is shaped to substantially match the outline shape of syringe port plug 140 of the drug reconstitution assembly 100. In the shipping position, syringe port plug 140 faces downward towards the bottom of assembly to mate with well 20*c*. The syringe port plug 140's engagement with well 20*c* inhibits rotational movement of the port within body 14. The syringe port plug 140 also mates with well 20*c* to provide an additional axial constraint on the housing 100 with respect to the body 14. Orienting the syringe port plug 140 downwardly towards the lower end of assembly 100 prevents the user, upon peeling back removable lid 12, from removing drug reconstitution assembly 100 by the syringe port plug 140, which can increase the likelihood that the plug 140 accidentally detaches from the syringe port increases. Syringe port plug 140 should instead be removed just before the connection of assembly 100 by an external syringe.

FIG. 5 illustrates that two protrusions 16 extend from package body 14 inwardly into the interior chamber of the body. As illustrated in FIG. 6, protrusions 16 include several geometrical features that are formed to cooperate with mating features of drug reconstitution assembly 100. Specifically, each protrusion 16 includes multiple faces including a tapered face 16*a*, a lid side face 16*b*, a body side face 16*c*, an upper face 16*d*, and a lower face 16*e*. FIGS. 1 to 6 make it clear that the two protrusions 16 extend in from the outside of body 14 spaced equally on either side of the longitudinal center of body 14.

FIG. 2 shows the exploded view of how the drug reconstitution assembly 100 fits within the body 14. When the drug reconstitution assembly 100 is inserted into the body 14, the two protrusions 16, extend through two corresponding apertures 116 of the upper housing portion 112. As illustrated in FIG. 4, protrusion 16 extends through aperture 116 toward the upper container 120. Specifically, body side face 16*c* of protrusion 16 is configured and arranged to engage with side 116*a* of the upper housing portion 112 forming aperture 116, the lid side face 16*b* of protrusion 16 is configured and arranged to engage with side 116*b* of the upper housing portion 112 forming aperture 116, the upper face 16*d* is configured and arranged to engage with side 116*c* of the upper housing portion 112 forming aperture 116, and the lower face 16*e* is configured and arranged to engage with side 116*d* of the upper housing portion 112 forming aperture 116.

The engagement between protrusions 16 and apertures 116 prevents drug reconstitution assembly 100 from translating axially or rotating within body 14. In particular, the lid side face 16*b* contacts side 116*b* of the upper housing portion 112 forming aperture 116, and body side face 16*c* contacts side 116*a* of the upper housing portion 112 forming aperture 116 to prevent the drug reconstitution assembly 100 from rotating within body 14. Similarly, lower face 16*e* contacts side 116*d* of the upper housing portion 112 forming aperture 116, and the upper face 16*d* contacts side 116*c* of the upper housing portion 112 forming aperture 116 to prevent the drug reconstitution assembly 100 from translating axially within body 14.

In various embodiments, the protrusions 16 need not make constant or any contact with the sides 116*c*, 116*d* of the aperture 116 while making physical contact with the upper vial 121 of upper container 120. It should be appreciated that the protrusions 16 help to hold upper container 120 secure within the upper housing portion 112 because any axial shift of the upper container 120 is inhibited by the protrusions 16, and any axial shift of the apertures 116 (i.e., the upper housing portion 112) is inhibited by the same protrusions 16. Because the protrusions 16 extend between the apertures 116 and between the neck 122*a* and rim 126 of the upper vial 121 of upper container 120, the protrusions 16, and therefore the body 14, prevent axial shift of the upper container 120 with respect to the upper housing portion 112.

Similar to the protrusions 16 discussed above, body 14 also includes two protrusions 18 at its lower end, which extend from body 14 inwardly into the interior chamber of the body. In FIG. 6, one of protrusions 18 is illustrated in greater detail. Like protrusions 16, protrusion 18 includes several geometrical features that are sized and arranged with respect to body 14 to cooperate with mating features of the drug reconstitution assembly 100 when inserted into package 10. Specifically, protrusion 18 includes a tapered face 18*a*, a lid side face 18*b*, a body side face 18*c*, a lower face 18*d*, and an upper face 18*e*. FIGS. 1 to 6 make it clear that the two protrusions 18 extend inwardly from body 14 spaced equally on either side of the longitudinal center of body 14.

FIG. 2 shows that when the drug reconstitution assembly 100 is inserted into the body 14, the two protrusions 18, extend through two corresponding apertures 118 of the lower housing portion 114. As illustrated in FIG. 4, protrusion 18 extends through aperture 118 towards lower container 130. Specifically, the body side face 18*c* of protrusion 18 is configured to engage with side 118*a* of the lower housing portion 114 forming aperture 118, the lid side face 18*b* of protrusion 18 is configured to engage with side 118*b* of the lower housing portion 114 forming aperture 118, the lower face 18*d* is configured to engage with side 118*c* of the lower housing portion 114 forming aperture 118, and the upper face 18*e* is configured to engage with side 118*d* the lower housing portion 114 forming aperture 118.

The engagement between protrusions 18 and apertures 118 prevents drug reconstitution assembly 100 from translating axially or rotating within body 14. In particular, the lid side face 18*b* contacts side 118*b* of the lower housing portion 114 forming aperture 118, and body side face 18*c* contacts side 118*a* of the lower housing portion 114 forming aperture 118 to prevent the drug reconstitution assembly 100 from rotating within body 14. Similarly, lower face 18*d* contacts side 118*c* of the lower housing portion 114 forming aperture 118, and the upper face 18*e* contacts side 118*d* of the lower housing portion 114 forming aperture 118 to prevent the drug reconstitution assembly 100 from translating axially within body 14.

In various embodiments, the protrusions 18 need not make constant or any contact with the sides 118*c*, 118*d* of the aperture 118 while making physical contact with the lower vial 131 of lower container 130. It should be appreciated that the protrusions 18 help to hold lower container 130 secure within the tower housing portion 114 because any axial shift of the lower container 130 is inhibited by the protrusions 18, and any axial shift of the apertures 118 (i.e., the lower housing portion 114) is inhibited by the same protrusions 18. Because the protrusions 18 extend between the apertures 118 and between the neck 132*a* and rim 136 of the lower vial 131 of lower container 130, the protrusions 18, and therefore the body 14, prevent axial shift of the lower container 130 with respect to the lower housing portion 114.

Protrusions 16 and 18 accordingly work in cooperation to prevent both axial and rotational movement of the housing 110 of the drug reconstitution assembly 100 within the package 10. While two of each protrusion 16 and 18 are illustrated mating respectively with two of each of the apertures 116 and 118, other embodiments include one of each protrusion 16 and 18 mating with one corresponding aperture 116 and 118, or more than two of each protrusion 16, 18 mating with more than two corresponding apertures 116, 118. It should also be appreciated that, for reasons discussed in more detail in the '967 Application, internal mechanisms and frictions within the drug reconstitution assembly 100 serve to secure the upper 120 and lower 130 containers with respect to the housing 110.

In various embodiments, if the upper 120 or lower 130 containers radially shift about the longitudinal axis of the drug reconstitution assembly 100, various internal seals or components described in more detail in the '967 Application could be compromised. It should be appreciated that, the protrusions 20*c*, 16, and 18 cooperate to prevent accidental rotational shift of the upper 120 or lower 130 containers within the housing 110, or any other features of the drug reconstitution assembly 100 within the package 10.

Referring again to FIGS. 3 to 6, the mating relationship between the body 14 with each of the upper vial 121 of container 120 and the lower vial 131 of lower container 130 is further discussed and illustrated. In addition to the interaction between protrusions 16 with housing 110 apertures 116 and protrusions 18 with housing 110 apertures 118 to prevent movement of housing 110 as described above, protrusions 16 also mate with different features of upper vial 121, while protrusions 18 also mate with different features of lower vial 131 to prevent significant movement of the upper 120 and tower 130 containers. To this end, protrusions 16 and 18 each extend through the respective apertures 116 and 118 to make contact with upper vial 121 and lower vial 131. In various embodiments, axial translation of the upper 120 and 130 containers with respect to the housing 110, and more specifically the upper housing portion 112 and tower housing portion 114 respectively, is inhibited by the protrusions 16 simultaneously engaging with upper vial 121 and apertures 116 and protrusions 18 simultaneously engaging with lower vial 131 and apertures 118.

As described above, the upper 120 and lower 130 containers are arranged so that the respective shoulders 122*b*, 132*b*, necks 122*a*, 132*a*, and rims 126, 136 of upper vial 121 and lower vial 131 are aligned with each of the apertures 116, 118 respectively. In the illustrated embodiment, protrusions 16 are configured to contact three different portions of upper vial 121, namely, the shoulder 122*b*, the neck 122*a*, and the rim 126. Similarly, the protrusions 18 contact three different portions of lower vial 131, namely, shoulder 132*b*, the neck 132*a*, and rim 136. FIG. 2 shows that port plug 140 ensures that apertures 116 and 118 are rotated properly to receive protrusions 16 and 18, respectively.

Tapered portion 16*c* of protrusion 16 of body 14 is configured to follow along the contour of and consequently hold the shoulder 122*b* of the upper vial 121. Likewise, tapered portion 18*c* of protrusion 18 of body 14 is configured to follow along the contour of and consequently hold shoulder 132*b* of the lower vial 131. Tapered portions 16*a*, 18*a* accordingly also serve to support each of the upper 121 and lower 131 vials so as to prevent significant translational shifting of the respective upper 120 and lower 130 containers within the package 10. To prevent movement of the vials to the undesirable displacement position it should be appreciated that, in various embodiments the tapered portions 16*a*, 18*a* need not make constant contact with the contoured shoulders 122*b*, 132*b*. Due to the contoured nature of the shoulders 122*b*, 132*b* and the corresponding tapered shape of the tapered portions 16*a*, 16*b*, the upper 120 and lower 130 containers are urged against shifting relative to the body 14 and the housing 110. The contoured shape of the body also provides a cradling effect that enables a snug fit between the upper 121 and lower 131 vials and the body 14.

In various embodiments, the lid side face 16*b* of protrusion 16 of body 14 is arranged to extend towards the neck 122*a* of the upper vial 121, between rim 126 and shoulder 122*b* of upper vial 121. Lid side face 16*b* wedged between rim 126 and shoulder 122*b* further serves to prevent translational shifting of the upper container 120 within package 10. Similarly, lid side face 18*b* of protrusion 18 is configured to extend towards neck 132*b* of lower vial 131 and between the rim 136 and the shoulder 132*b* of the lower vial 131. Lid side face 18*b* wedged between rim 136 and the shoulder 132*b* further serves to prevent translational shifting of the lower container 130 within package 10. To prevent movement of the vials to the undesirable displacement position it should be appreciated that, in various embodiments the lid side faces 16*b*, 18*b* need not make constant contact with the rims 126, 136 and shoulders 122*b*, 132*b*.

It should be appreciated that, although the transfer set assembly 200 is not necessarily part of either the upper 112 or lower 114 housings, the transfer set assembly 200 does remain static with respect to the housing due in part to its connection at the syringe port. Therefore, it should be appreciated that for similar principles described above regarding the containers 120, 130 and the housing 100, the body 14 and its protrusions 16, 18 also function to prevent axial translation of the upper 120 and lower 130 containers with respect to the transfer set assembly 200.

Additionally, due to the orientation of the tapers 116*a*, 118*a* formed into the body 14, the upper 120 and lower 130 containers are, if anything, urged away from the transfer set assembly 200. As illustrated in FIGS. 4 and 6, the shoulders 122*b*, 132*b* of the respective upper 121 and lower 131 vials rest upon the contours 116*a*, 118*a* respectively, which are angled such that, absent all other axial obstructions, the upper 120 and lower 130 containers would be unable to shift inward, or toward the transfer set assembly 200, and specifically the upper spike 202 and boot 206 and the lower spike 204 and boot 208 and into the undesirable displacement position. It should be appreciated that the upper 120 and lower 130 containers are inhibited from axial translation with respect to one another for at least the same reasons as why they are inhibited from axial translation with respect to the transfer set assembly 200.

End portion 22 of body 14 is formed to support and constrain different features of drug reconstitution assembly 100 when assembled in the package 10. FIG. 4 shows that end portion 22 of the body 14 is configured to constrain the upper container 120 by limiting upward axial movement of upper vial 121. End portion 22 also supports the base portion 122*c* of upper vial 121. Similarly, end portion 24 of the body 14 is configured to constrain the lower container 130 by limiting downward axial movement of lower vial 131. End portion 24 also supports the base portion 132*c* of lower vial 131. It should be appreciated that some embodiments include a body 14 that is toleranced such that the end portions 22, 24 make contact or near contact with the respective bottoms of the upper 121 and lower 131 vials, respectively. In various embodiments, the end portions 22, 24 do not make contact with the bottoms of the upper 121 and lower 131 vials respectively.

It should be appreciated from the above discussion that the geometry and features of formed body 14 interact at multiple contact locations with (i) drug reconstitution assembly 100 to prevent its rotational and translational movement, and (ii) upper 120 and lower 130 containers to prevent their rotational and translational movement into the undesirable displacement position.

Aspects of the subject matter described herein may be useful alone or in combination with one or more other aspects described herein. Without limiting the foregoing description, in a first aspect of the present disclosure, a medical package assembly includes: a drug reconstitution assembly including: (i) a housing forming at least one aperture, (ii) a container placed at least partially within an interior of the housing, and (iii) a spike assembly arranged within the housing so as to be able to spike the container; and a body shaped to house the drug reconstitution assembly, the body including at least one protrusion extending through the aperture and into the interior of the housing, wherein the at least one protrusion is positioned and arranged to prevent movement of the container toward the spike assembly prior to the container reaching an undesirable displacement relative to the spike assembly.

In accordance with a second aspect of the present disclosure, which may be used in combination with the first aspect, which includes a lid attached to the body and configured to sealingly enclose the drug reconstitution assembly within the body.

In accordance with a third aspect of the present disclosure, which may be used in combination with any one or more of the preceding aspects, wherein the lid is attached to the body with heat-activated adhesive.

In accordance with a fourth aspect of the present disclosure, which may be used in combination with any one or more of the preceding aspects, wherein the at least one protrusion is configured to prevent axial translation of the container relative to the housing.

In accordance with a fifth aspect of the present disclosure, which may be used in combination with any one or more of the preceding aspects, wherein the at least one protrusion further prevents rotation of the drug reconstitution assembly within the body.

In accordance with a sixth aspect of the present disclosure, which may be used in combination with any one or more of the preceding aspects, wherein the body is structured with at least one flat surface so as to prevent rolling of the body.

In accordance with a seventh aspect of the present disclosure, which may be used in combination with any one or more of the preceding aspects, wherein the drug reconstitution assembly includes a syringe port plug and the body includes a cavity shaped to mate with the syringe port plug of the drug reconstitution assembly.

In accordance with an eighth aspect of the present disclosure, which may be used in combination with any one or more of the preceding aspects, wherein the container is a first container, and which includes a second container placed at least partially within the housing of the drug reconstitution assembly, the housing forming at least one second aperture wherein the at least one protrusion is a first protrusion and which includes a second protrusion, the second protrusion positioned and arranged to extend through the second aperture and into the interior of the housing and prevent movement of the second container toward the spike assembly prior to the second container reaching an undesirable displacement relative to the spike assembly.

In accordance with a ninth aspect of the present disclosure, which may be used in combination with any one or more of the preceding aspects, wherein the container is a first vial including a neck and a shoulder, the first container arranged relative to the housing to align at least a portion of the neck of the first vial with the first at least one aperture, the first at least one protrusion configured to extend toward the neck and engage the shoulder prior to the first vial reaching an undesirable displacement relative to the spike assembly.

In accordance with a tenth aspect of the present disclosure, which may be used in combination with any one or more of the preceding aspects, wherein the container is a first container, and including a second container placed at least partially within the housing of the drug reconstitution assembly and the second container is a vial including a neck and a shoulder, the housing forming at least one second aperture, the second container arranged relative to the housing to align at least a portion of the neck of the second container with the at least one second aperture wherein the at least one protrusion is a first protrusion and the body forming a second protrusion, the second protrusion positioned and arranged to extend through the second aperture and into the interior of the housing toward the neck of the second container and engage the shoulder of the second container prior to the second container reaching an undesirable displacement relative to the spike assembly.

In accordance with an eleventh aspect of the present disclosure, which may be used in combination with any one or more of the preceding aspects, a drug delivery product includes: a drug reconstitution assembly including a housing and a container placed within the housing; and a package including a body shaped to house the drug reconstitution assembly and at least one protrusion extending from the body, the at least one protrusion positioned and arranged to engage the housing and the container to inhibit axial translation of the container relative to the housing.

In accordance with a twelfth aspect of the present disclosure, which may be used in combination with any one or more of the preceding aspects in combination with the eleventh aspect, wherein the container is a first container and which includes a second container placed within the housing, the protrusion a first protrusion, the body including a second protrusion positioned and arranged to engage with the housing to inhibit axial translation of the second container relative to the housing.

In accordance with a thirteenth aspect of the present disclosure, which may be used with any one or more of the preceding aspects in combination with the eleventh aspect, wherein the first protrusion engages the housing at a first location adjacent the first container and the second protrusion engages the housing at a second location adjacent the second container.

In accordance with a fourteenth aspect of the present disclosure, which may be used with any one or more of the preceding aspects in combination with the eleventh aspect, wherein the first and second engagements include the first and second protrusions extending through first and second apertures, respectively, of the housing.

In accordance with a fifteenth aspect of the present disclosure, which may be used with any one or more of the preceding aspects in combination with the eleventh aspect, wherein at least one of: (i) the first aperture is one of a plurality of first apertures spaced radially about the housing or (ii) the second aperture is one of a plurality of second apertures spaced radially about the housing.

In accordance with a sixteenth aspect of the present disclosure, which may be used with any one or more of the preceding aspects in combination with the eleventh aspect, wherein the first and second protrusions extending through the first and second apertures further inhibit rotational movement of the housing relative to the body.

In accordance with a seventeenth aspect of the present disclosure, which may be used with any one or more of the preceding aspects in combination with the eleventh aspect, wherein the first and second containers are accessed by a transfer set assembly, the transfer set assembly including a port accessible by a user, the body including a well positioned and arranged to engage the port, or a plug plugging the port, to inhibit axial movement of the housing.

In accordance with an eighteenth aspect of the present disclosure, which may be used with any one or more of the preceding aspects in combination with the eleventh aspect, wherein the engagement of the drug reconstitution assembly by the at least one protrusion also inhibits rotational movement of the hosing relative to the body.

In accordance with a nineteenth aspect of the present disclosure, which may be used with any one or more of the preceding aspects in combination with the eleventh aspect, wherein the engagement of the drug reconstitution assembly by the at least one protrusion also inhibits axial movement of the housing relative to the body.

In accordance with a twentieth aspect of the present disclosure, which may be used with any one or more of the preceding aspects, a method of packaging a drug reconstitution assembly, comprising: providing a package with a removable lid and a body configured to house the drug reconstitution assembly, including at least one protrusion extending from the body; providing the drug reconstitution assembly with a housing having at least one aperture, and a container placed at least partially within the housing, wherein a neck portion of the container aligns with at least one of the apertures of the housing; assembling the drug reconstitution assembly within the body of the package, such that the at least one protrusion of the body extends through at least one of the apertures of the housing, wherein an orientation of the drug reconstitution assembly within the package is limited to a predetermined number of orientations; and sealing the drug reconstitution assembly within the body of the package with the removable lid.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A medical package assembly, the medical package assembly comprising:

a drug reconstitution assembly including:

(i) a housing forming at least one aperture, the at least one aperture including a hole having a perimeter completely defined by the housing, (ii) a container, at least a portion of the container extending within an interior of the housing, and (iii) a spike assembly arranged within the housing so as to be able to spike the container; and a body shaped to house the drug reconstitution assembly, the body including at least one protrusion extending through the at least one aperture and into the interior of the housing, wherein the at least one protrusion is positioned and arranged to prevent movement of the container toward the spike assembly prior to the container reaching an undesirable displacement relative to the spike assembly.

2. The medical package assembly of claim 1, which includes a lid attached to the body and configured to sealingly enclose the drug reconstitution assembly within the body.

3. The medical package assembly of claim 2, wherein the lid is attached to the body with heat-activated adhesive.

4. The medical package assembly of claim 2, wherein the at least one protrusion is configured to prevent axial translation of the container relative to the housing.

5. The medical package assembly of claim 1, wherein the at least one protrusion further prevents rotation of the drug reconstitution assembly within the body.

6. The medical package assembly of claim 1, wherein the body is structured with at least one flat surface so as to prevent rolling of the body.

7. The medical package assembly of claim 1, wherein the drug reconstitution assembly includes a syringe port plug and the body includes a cavity shaped to mate with the syringe port plug of the drug reconstitution assembly.

8. The medical package assembly of claim 1, wherein the container is a first container, and which includes a second container, at least a portion of the second container extending within the housing of the drug reconstitution assembly, the housing forming at least one second at least one aperture, the second aperture including a hole having a perimeter completely defined by the housing, wherein the at least one protrusion is a first protrusion and which includes a second protrusion, the second protrusion positioned and arranged to extend through the second at least one aperture and into the interior of the housing and prevent movement of the second container toward the spike assembly prior to the second container reaching an undesirable displacement relative to the spike assembly.

9. The medical package assembly of claim 1, wherein the container is a first container including a neck and a shoulder, the first container is arranged relative to the housing to align first at least a portion of the neck of the first vial with the first at least one aperture, the first at least one protrusion configured to extend toward the neck and engage the shoulder prior to the first vial reaching an undesirable displacement relative to the spike assembly.

10. The medical package assembly of claim 9, wherein the container is a first container, and including a second container, at least a portion of the second container extending within the housing of the drug reconstitution assembly and the second container is a vial including a neck and a shoulder, the housing forming at least one second aperture, the at least one second aperture including a hole having a perimeter completely defined by the housing, the second container arranged relative to the housing to align at least a portion of the neck of the second container with the at least one second aperture wherein the at least one protrusion is a first protrusion and the body forming a second protrusion, the second protrusion positioned and arranged to extend through the at least one second aperture and into the interior of the housing toward the neck of the second container and engage the shoulder of the second container prior to the second container reaching an undesirable displacement relative to the spike assembly.

11. A drug delivery product comprising:

a drug reconstitution assembly including a housing and a container placed within the housing; and a package including a body shaped to house the drug reconstitution assembly and at least one protrusion extending from the body, the at least one protrusion positioned and arranged to engage the housing and the container through at least one aperture in the housing to inhibit axial translation of the container relative to the housing, the at least one aperture including a hole having a perimeter completely defined by the housing.

12. The drug delivery product of claim 11, wherein the container is a first container and which includes a second container placed within the housing, the at least one protrusion is a first protrusion, the body including a second protrusion positioned and arranged to engage with the housing to inhibit axial translation of the second container relative to the housing.

13. The drug delivery product of claim 12, wherein the first protrusion engages the housing at a first location adjacent the first container and the second protrusion engages the housing at a second location adjacent the second container.

14. The drug delivery product of claim 12, wherein the first and second engagements include the first and second protrusions extending through first and second apertures, respectively, of the housing, wherein the first and second apertures include a first hole and a second hole respectively, the first and second hole each having a perimeter completely defined by the housing.

15. The drug delivery product of claim 14, wherein at least one of: (i) the first aperture is one of a plurality of first apertures spaced radially about the housing, the plurality of first apertures including a plurality of first holes respectively, each of the plurality of first holes having a perimeter completely defined by the housing or (ii) the second aperture is one of a plurality of second apertures spaced radially about the housing, the plurality of second apertures including a plurality of second holes respectively, each of the plurality of second holes having a perimeter completely defined by the housing.

16. The drug delivery product of claim 14, wherein the first and second protrusions extending through the first and second apertures further inhibit rotational movement of the housing relative to the body.

17. The drug delivery product of claim 12, wherein the first and second containers are accessed by a transfer set assembly, the transfer set assembly including a port configured to be accessible by a user, the body including a well positioned and arranged to engage the port, or a plug plugging the port, to inhibit axial movement of the housing.

18. The drug delivery product of claim 11, wherein engagement of the drug reconstitution assembly by the at least one protrusion also inhibits rotational movement of the housing relative to the body.

19. The drug delivery product of claim 11, wherein engagement of the drug reconstitution assembly by the at least one protrusion also inhibits axial movement of the housing relative to the body.

20. A method of packaging a drug reconstitution assembly, comprising:

providing a package with a removable lid and a body configured to house the drug reconstitution assembly, including at least one protrusion extending from the body;

providing the drug reconstitution assembly with a housing having at least one aperture, and a container, at least a portion of the container extending within the housing, wherein a neck portion of the container aligns with the at least one aperture of the housing, the at least one aperture including a hole having a perimeter completely defined by the housing;

assembling the drug reconstitution assembly within the body of the package, such that the at least one protrusion of the body extends through the at least one aperture of the housing, wherein an orientation of the drug reconstitution assembly within the package is limited to a predetermined number of orientations; and sealing the drug reconstitution assembly within the body of the package with the removable lid.

* * * * *

UNITED STATES PATENT AND TRADEMARK OFFICE

CERTIFICATE OF CORRECTION

PATENT NO. : 8,734,420 B2
APPLICATION NO. : 13/402560
DATED : May 27, 2014
INVENTOR(S) : Ariagno et al.

It is certified that error appears in the above-identified patent and that said Letters Patent is hereby corrected as shown below:

In the Claims:

Column 15, line 23, delete the phrase “at least one” before the word “aperature”.

Column 15, line 24, insert the phrase --at least one-- before the word “second”.

Column 15, line 28, replace the phrase “second at least one” with the phrase --at least one second--.

Column 15, line 34, replace the word “container” with the word --vial--.

Column 15, line 35, replace the word “container” with the word --vial--.

Column 15, line 36, delete the first word of the sentence “first” and delete the last word of the sentence “first”.

Signed and Sealed this
Ninth Day of September, 2014

Michelle K. Lee

Michelle K. Lee
*Deputy Director of the United States Patent and Trademark Office*